US005410835A

United States Patent [19]

Vetter

[11] Patent Number: 5,410,835

[45] Date of Patent: May 2, 1995

[54] FIREARM BIPOD

[76] Inventor: W. Moray Vetter, P.O. Box 633, Moorefield, W. Va. 26836

[21] Appl. No.: 172,924

[22] Filed: Dec. 27, 1993

Related U.S. Application Data

[63] Continuation-in-part of Ser. No. 731,945, Jul. 18, 1991, Pat. No. 344,566.

[51] Int. Cl.[6] ..... F41C 29/00

[52] U.S. Cl. ..... 42/94

[58] Field of Search ..... 42/94; 89/37.04, 40.06

[56] References Cited

U.S. PATENT DOCUMENTS

| | | | |
|---|---|---|---|
| D. 182,142 | 2/1958 | Sharp | 42/94 |
| 2,569,435 | 9/1951 | Martin | 42/94 |
| 3,233,517 | 2/1966 | Morrison | 89/37.04 |
| 3,576,084 | 4/1971 | Anderson | 42/94 |
| 3,584,821 | 6/1971 | Glebe | 248/156 |
| 3,935,657 | 2/1975 | Wade | 42/94 |
| 3,947,988 | 4/1976 | Besaw | 42/94 |
| 4,012,860 | 3/1977 | Auger | 42/94 |
| 4,265,045 | 5/1981 | Garbini | 42/94 |
| 4,397,112 | 8/1983 | York | 42/94 |
| 4,676,021 | 6/1987 | Groba | 42/94 |
| 4,854,066 | 8/1989 | Canterbury, Sr. | 42/94 |
| 4,882,869 | 11/1989 | Webster | 42/94 |
| 5,317,826 | 6/1994 | Underwood | 42/94 |

*Primary Examiner*—David Brown

[57] ABSTRACT

A bipod support for a firearm comprises a first strut and a second strut angularly related to each with one of the struts having an elongated projection serving as the rest for the barrel of a rifle or a pistol when the two struts are positioned upright on the ground. In one embodiment, the first and second struts are hinged to each other so that they may be folded relative to each other for compact storage. In an alternative embodiment, the first strut is a hollow tubular member and the second strut may be placed inside the first strut in a coaxial telescoped manner for easy storage. One end of the second strut is beveled so that when it is inserted in an opening in the wall of the first strut it forms the desired angular relationship therewith. A series of rubber grommets on the barrel of the second strut resiliently engages the inside wall of the first strut when the two parts are telescoped together to thereby frictionally maintain the parts together and avoid relative movement therebetween.

10 Claims, 5 Drawing Sheets 14a
16a
12a
62
40a
66
20a
66
24a
18a 16a
14a
68
72
22a
70
12a
66

FIREARM BIPOD

RELATED APPLICATION

This application is a continuation-in-part of my prior application, Ser. No. 07/731,945, filed Jul. 18, 1991,now U.S. Pat. No. Des. 344,566.

BACKGROUND OF THE INVENTION

1. Field of the Invention

The present invention relates generally to multi-legged supports, and more particularly, to an erectable bipod especially adapted to serve as a support for a firearm.

2. Description of the Prior Art

Hunters operating in the open field or bush country are at a disadvantage because no trees or other naturally occurring supports (e.g. rock outcroppings) may not naturally be available to provide cover and serve as a fixed support for the firearm being used. By fixed support is meant an object upon which the firearm may be rested so as to provide a firm, vibration free base so that accurate aiming of the weapon may take place. Some, but not all firearms, have integral supports hinged to the barrel of the weapon to serve as a tripod mount. Also, it is known to use the forked branch of a tree to steady the aim of a rifle. Such prior art devices, however, suffer from various shortcomings. A need definitely exists for a portable erectable support which may be carried into the field to serve as a support for a firearm such a pistol or a rifle. Ideally, such supports should be light in weight, durable in construction, have few moving parts, be capable of providing firm support for a wide range of different types of firearms, and be easily and quickly erectable, in addition to being simple in design, easy to manufacture and low in cost.

The foregoing need is met by the present invention as will be made apparent from the following description thereof. Other advantages of the present invention over the prior art also will be rendered evident.

SUMMARY OF THE INVENTION

To achieve the foregoing and other advantages, the present invention, briefly described, provides a bipod support for a firearm comprises a first strut and a second strut angularly related to each with one of the struts having an elongated projection serving as the rest for the barrel of a rifle or a pistol when the two struts are positioned upright on the ground. In one embodiment, the first and second struts are hinged to each other so that they may be folded relative to each other for compact storage. In an alternative embodiment, the first strut is a hollow tubular member and the second strut may be placed inside the first strut in a coaxial telescoped manner for easy storage. One end of the second strut is beveled so that when it is inserted in an opening in the wall of the first strut it forms the desired angular relationship therewith. A series of rubber grommets on the barrel of the second strut resiliently engages the inside wall of the first strut when the two parts are telescoped together to thereby frictionally maintain the parts together and avoid relative movement therebetween.

The above brief description sets forth rather broadly the more important features of the present invention in order that the detailed description thereof that follows may be better understood, and in order that the present contributions to the art may be better appreciated.

There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved firearm bipod which has all of the advantages of the prior art and none of the disadvantages.

It is another object of the present invention to provide a new an improved firearm bipod which may be easily and efficiently manufactured and marketed.

It is a further objective of the present invention to provide a new and improved firearm bipod that is of durable and reliable construction.

An even further object of the present invention is to provide a new and improved firearm bipod susceptible of a low cost of manufacture with regard to both materials and labor, and which accordingly is then susceptible of low prices of sale to the consuming public, thereby making such firearm bipod available to the buying public.

Still yet a further object of the present invention is to provide a new and improved firearm bipod that is portable, yet easily erectable in the field.

Another object of the present invention is to provide a new and improved firearm bipod that includes two intergageable strut potions and relatively simple means for erecting the two strut portions thereof at the required angular relationship so that the invention may readily provide a firm, vibration free base for a weapon in firing position.

Still a further object of the present invention is to provide a new and improved firearm bipod that may be used with weapons of different type, e.g. pistols and/or rifles.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
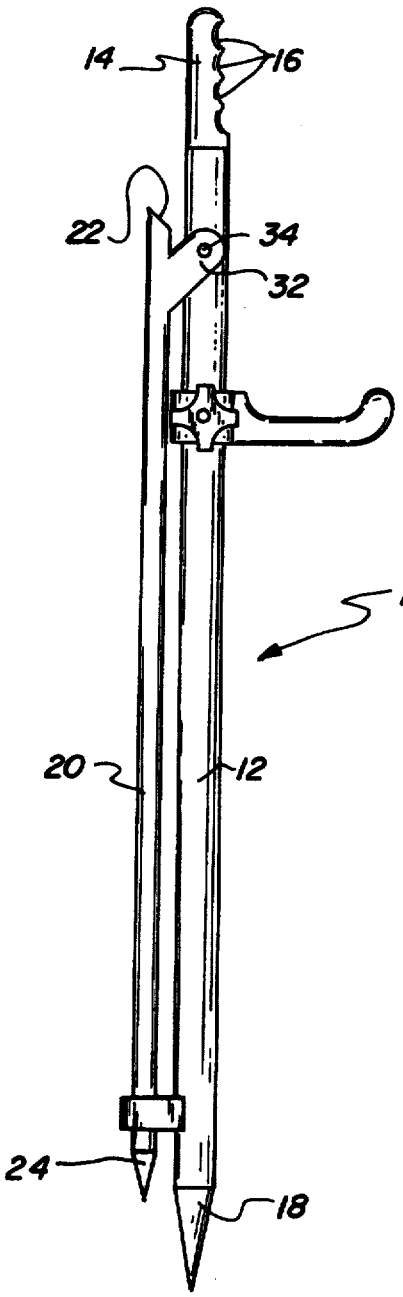
FIG. 1 is an elevation view showing the first preferred embodiment of the firearm bipod of the invention in a folded or non erected condition.

With reference now to the drawings, a new and improved firearm bipod embodying the principles and concepts of the present invention will be described.

Turning initially to FIGS. 1—4, there is shown a first preferred embodiment of the portable erectable firearm bipod of the invention generally designated by reference numeral 10. In one preferred form, firearm bipod 10 comprises a generally cylindrically shaped first or main strut 12 having an elongated longitudinal extent substantially as shown and terminating at its upper end in a handle portion 14 having finger gripping indentations 16, and terminating at its other opposite end in a conically shaped tip 18.

A second strut 20 is hingedly attached to first strut 12 in such a way as to be readily pivoted from a folded or non-erect condition (FIG. 1) to an erected or open condition (FIG. 2) where the longitudinal axis of the second strut makes an angle of about 45 degrees relative to the longitudinal axis of the first strut.

Figure 2:
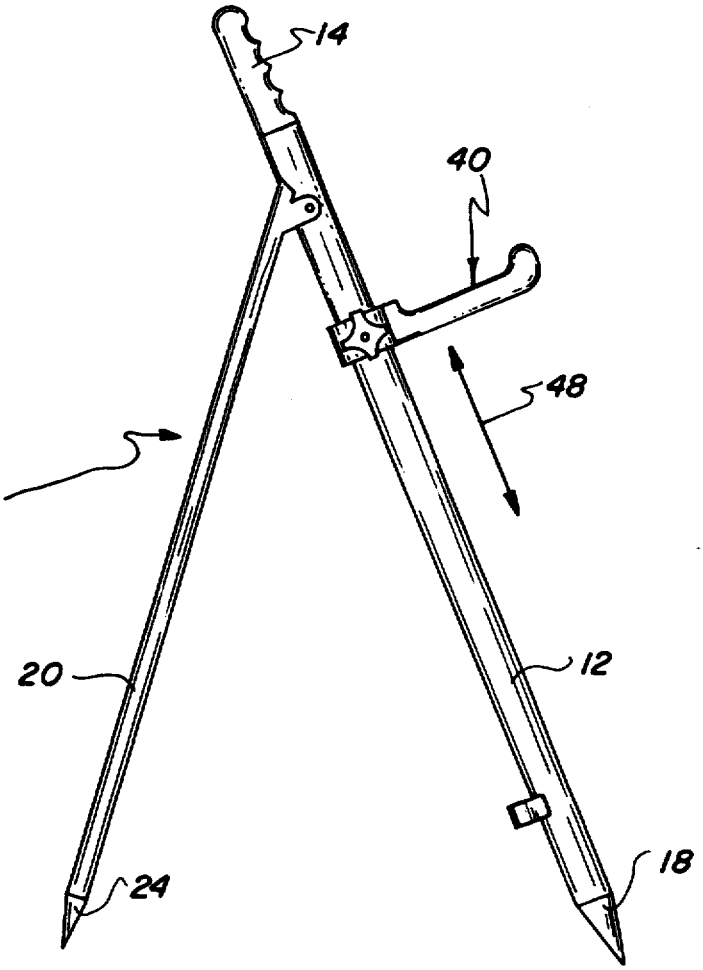
FIG. 2 is a cross-sectional elevational view of the firearm bipod of Figure in an erected open condition.
Figure 3:
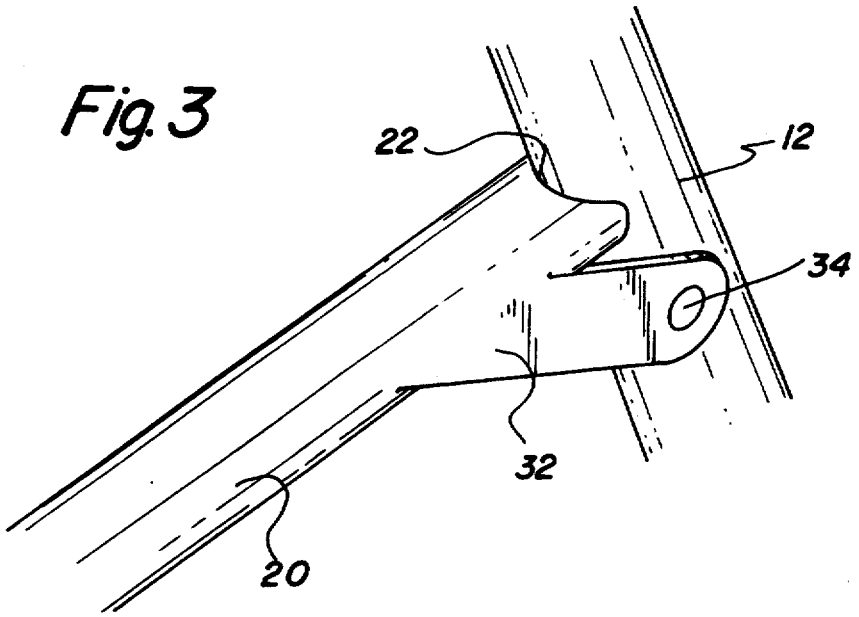
FIG. 3 is an enlarged perspective view showing in detail the hinge connection between the first and second struts of the firearm bipod of FIGS. 1 and 2.
Figure 4:
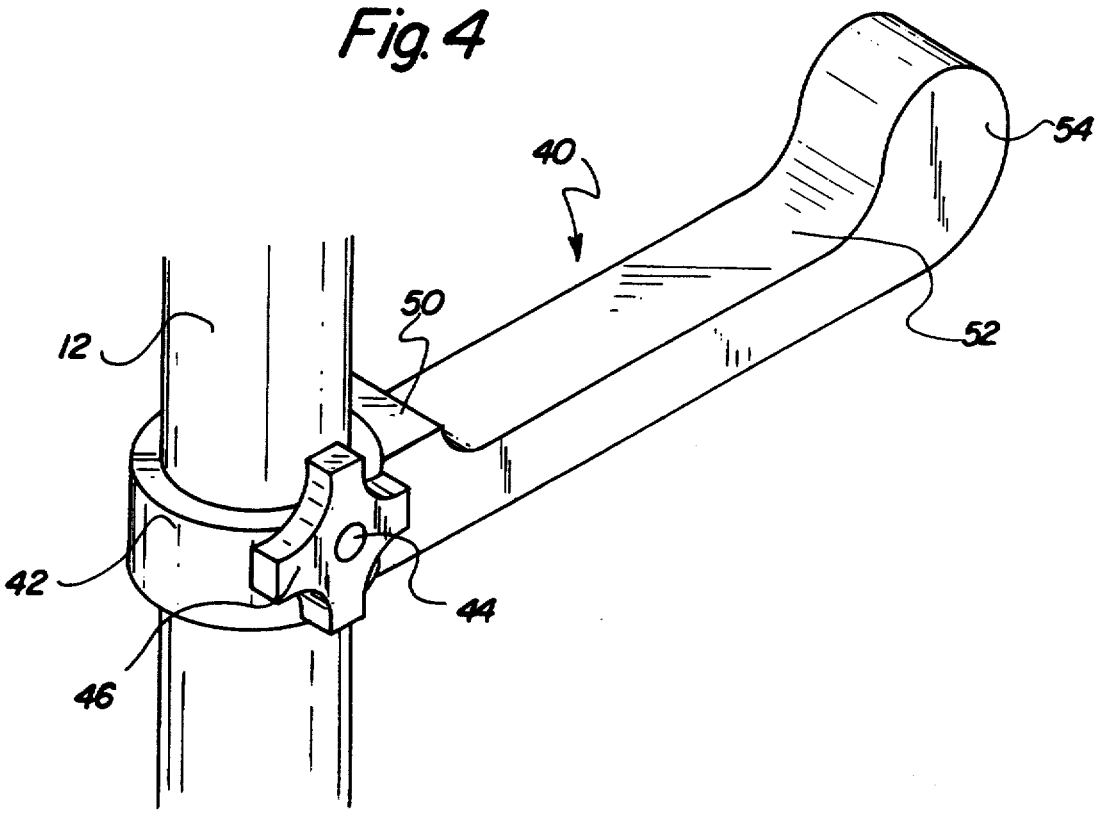
FIG. 4 is an enlarged perspective view showing in detail the adjustable connection of the arm rest of the firearm bipod of FIGS. 1 and 2.
Figure 6:
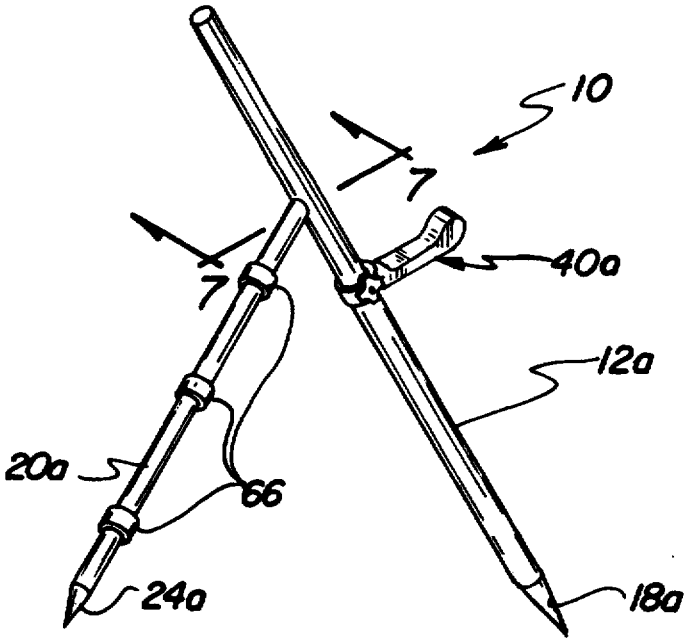
FIG. 6 is a perspective view of an alternative embodiment of the firearm bipod according to the present invention.
Figure 5:
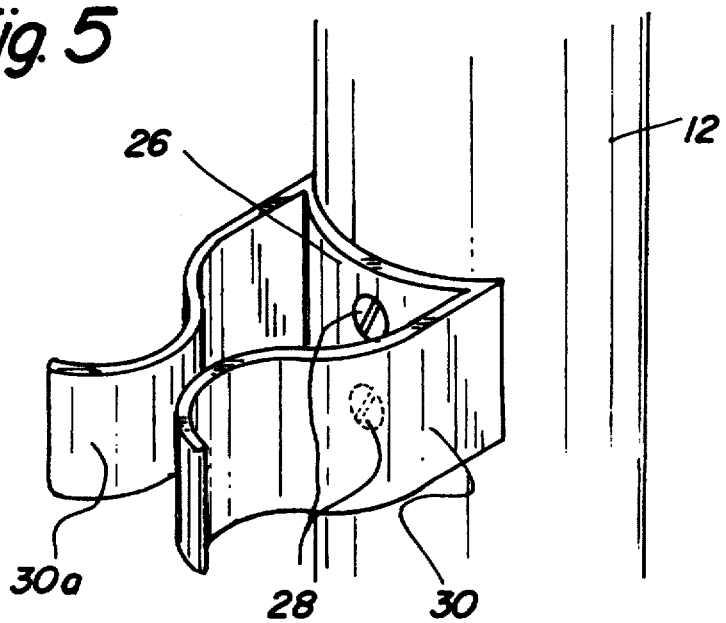
FIG. 5 is an enlarged perspective view showing in detail the spring clip retainer of the firearm bipod of FIGS. 1 and 2.

Second strut 20 also is generally cylindrical in shape, albeit preferably of a smaller diameter relative to the diameter of the first strut, and terminates at its upper end in a beveled concave surface 22 adapted to engage the outer cylindrical surface of first strut 12 as best seen in FIG. 3. The bottom or opposite end of strut 20 defines a conically shaped tip 24 similar to conical tip 18 of first strut 12. In order to maintain strut 20 in the non-pivoted or closed condition of FIG. 1, a spring clip 26 is attached to the outer cylindrical surface of first strut 12 by means of a pair of screw fasteners 28 near the distal or bottom end of first strut 12 substantially as shown in FIGS. 1 and 2. The spring clip has a pair of opposed inwardly curved resilient leaf members 30, 30*a* which may be resiliently spread apart to receive therebetween the bottom portion of the second strut when the latter is pivoted toward the first strut and engaged therewith in a manner believed apparent. Spring clip 26 thus facilitates retention of the second strut in the non-pivoted, non-erected, folded condition relative to the first strut, but permits easy and rapid pivotal movement therebetween to establish the erect open condition illustrated in FIG. 2 when and as desired.

FIG. 3 shows in greater detail the preferred construction of the hinge connection between the first strut and the second strut. As depicted therein, a pair of identical opposed tabs, only one of which is shown, namely tab 32 extends at a suitable angle with respect to the longitudinal axis of the second strut and is attached pivotally to the first strut via a transverse pivot pin 34 suitably anchored on the first strut 12. The angle tab 32 makes with the axis of the second strut is such as to assure that curved surface 22 fully seats against the curved cylindrical surface of first strut 12 when the second strut is pivoted to the open, erected condition of FIG. 2.

In accordance with the present invention, an axially adjustable arm rest generally indicated by reference numeral 40 projects orthogonally from first strut 12 and is slidably mounted thereon by means of a collar 42. A male threaded set screw 44 extends transversely through a complimentary female threaded hole in the collar (not shown) to releasably engage the outer surface of first strut 12. A handle 46 is attached to the set screw to facilitate tightening and loosening of the set screw so that the collar and therefore the arm rest may be selectively axially moved to a desired adjusted position on the first strut as indicated by arrow 48 (FIG. 2). Arm rest 40 has a longitudinal extent long enough to support either the barrel of a rifle, or if using a pistol the arm of the user. In this regard, and as seen to good advantage in FIG. 4, arm rest 40 is provided with a first portion 50 proximal to collar 42, a reduced thickness middle portion 52 defining a cradle, and a third outer or distal portion 54 enlarged with respect to middle portion 52 and shaped generally in the form of a circular knob. The latter provides means for helping to maintain the barrel of a firearm or other object (e.g. the arm of the user) on the cradle or middle portion during use thereby preventing it from sliding off.

In use, the firearm bipod 10 may be carried in its folded position (FIG. 1) to a position in the field. It may be transported in any convenient manner such as for example, strapped to a backpack, or carded by means of handle 14 in the manner of a walking stick. Once a chosen location is found, the bipod 10 is erected by pivoting the second strut to its open condition and placing the conically tipped ends 18, 24 in the ground until the bipod remains upright without any assistance. The firearm or arm of the user may then be placed on the cradle or middle portion of the arm rest 40 to thereby establish a firm base of support for the firearm enabling accurate aiming thereof.

Figure 9:
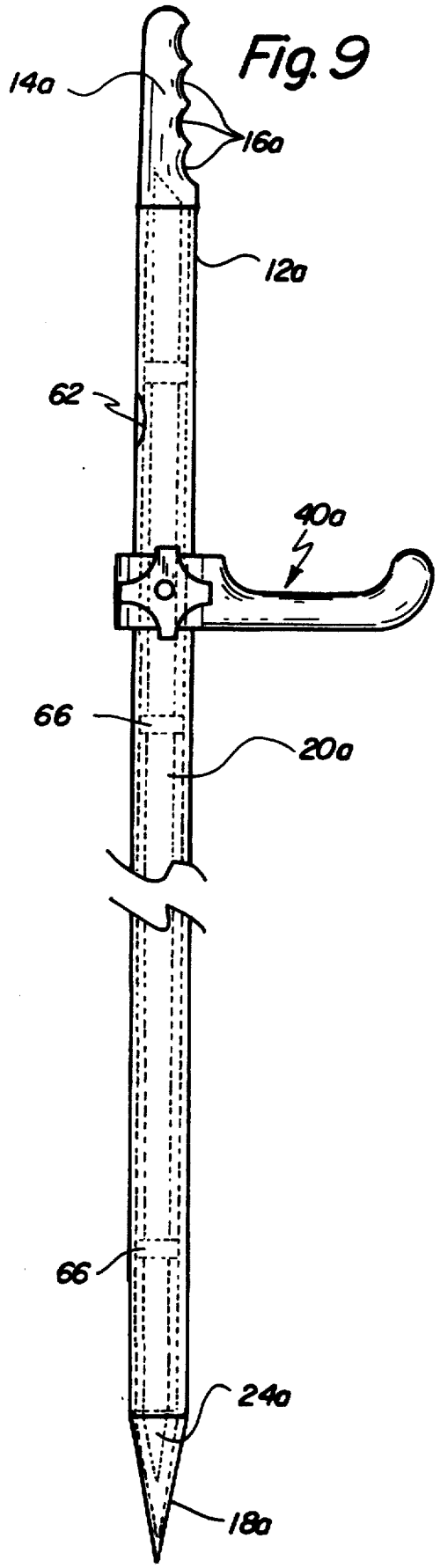
FIG. 9 is an elevational view of the alternative embodiment shown in a stowed telescoped condition.
Figure 10:
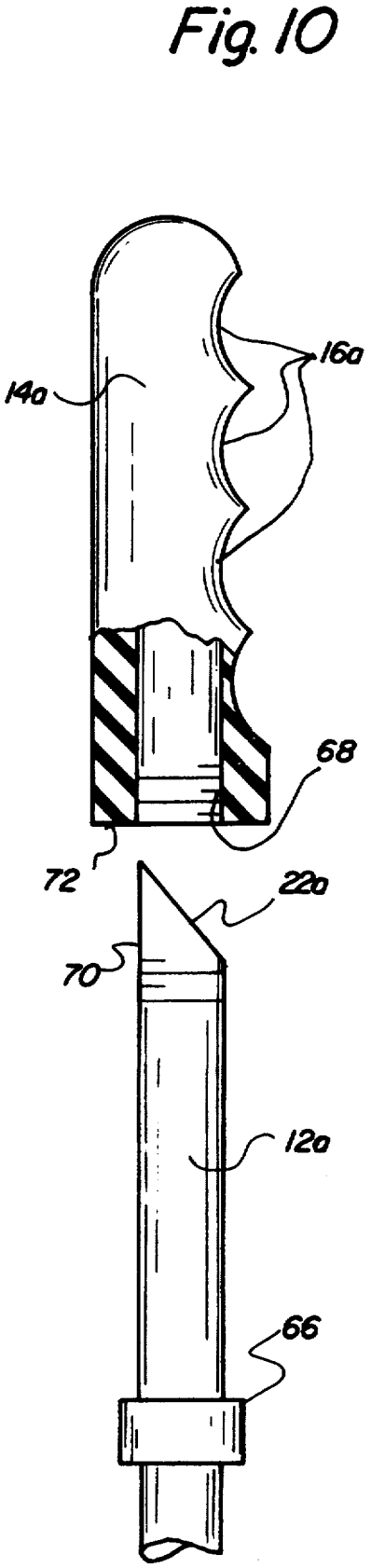
FIG. 10 is an enlarged elevation partial enlarged view of one of the strut portions of the alternative embodiment showing the removable handle thereof.

Turning now to FIGS. 5 through 10, an alternatively preferred embodiment of the invention will be described wherein like reference numerals are used to refer to like parts already described. In the alternative embodiment, first strut 12*a* has an open top end and is hollow to define an interior cylindrical cavity 60 therein. In addition to having an open top end, first strut 12*a* furthermore includes an oblong shaped opening or slot 62 in the side wall thereof to permit the top beveled surface 22*a* of second strut 20*a* to be received therein. The second strut 20*a* rather than being hinged to the first strut as in the embodiment of FIG. 1 thorough 4, is entirely detachable from the first strut and is adapted in accordance with an important feature of the invention to be telescopically axially received in the interior cavity 60 of the first strut when the bipod is not in use. This arrangement is illustrated in FIG. 9 where the second strut 20a is shown inside the first strut 12a by a broken line outline thereof. In order to facilitate a snug fit between the telescoped struts, a series of resilient grommets 66 (e.g. rubber) are spaced axially along the longitudinal extent of the second strut. Grommets 66 also prevent the telescoped struts from rattling or otherwise moving relative to each other when in the telescoped non-erected condition. It is thus seen that the first strut serves as a convenient carrying case or housing for the second strut. Handle 14a is adapted to be selectively fastened to the top beveled surface 22a of second strut 20a by means of a female threaded axial recess 68 adapted to be engaged with complimentary male threads 70 on the exterior of strut 20a below beveled surface 22a (FIG. 10). When handle 14a is affixed to second strut 20a, the latter's distal end may be inserted through the top opening in the first strut 12a and pushed into the cavity thereof until the shoulder 72 defined by the bottom edge of handle 14a engages or seats upon the top edge of the first strut surrounding the opening thereof in a manner similar to a sword being placed into its scabbard.

Figure 7:
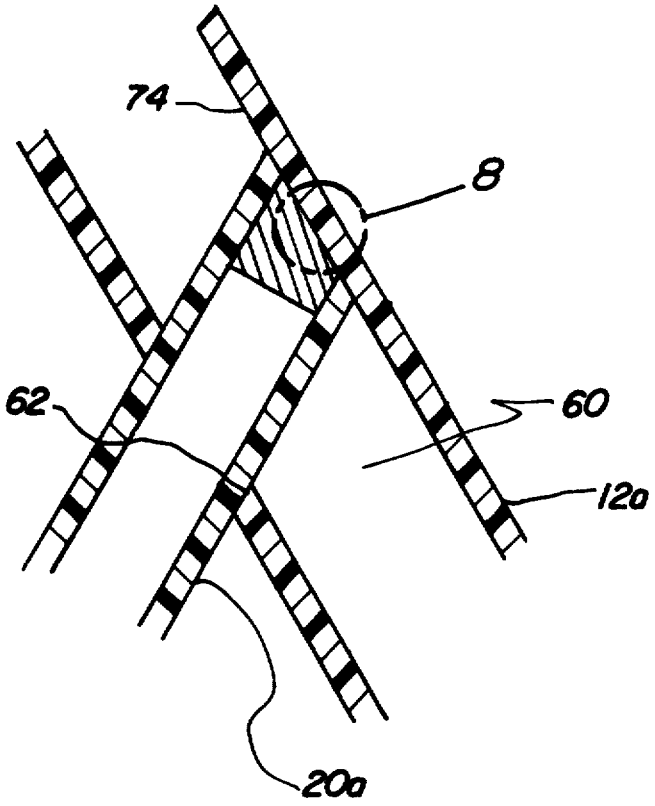
FIG. 7 is a partial cross-sectional enlarged view taken along line 7—7 of FIG. 6.
Figure 8:
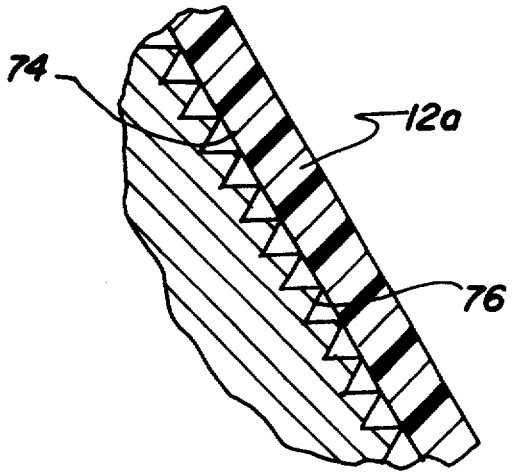
FIG. 8 is still a further enlarged view of a portion of FIG. 7.

When it is desired to erect the embodiment of the bipod shown in FIGS. 5 through 10, all that is necessary is to withdraw the second strut from the cavity in the first strut, remove the handle, and insert the beveled top end into oblong slot 62 until the beveled surface 22a seats upon inside wall surface 74 of first strut 12a as shown in FIG. 7. If desired, beveled surface 22a may be provided with a sawtooth surface 76 to facilitate a firm frictional engagement of surface 22a with surface 74, the first strut and the second strut will assume the desired relative angular relationship shown in FIG. 6 when the parts are assembled as aforesaid.

In fabricating the present invention, any light weight, durable materials may be used with aluminum being particularly preferred for the first and second struts and the arm rest, and molded plastic (e.g. PVC) being especially preferred for the handle.

It is apparent from the above that the present invention accomplishes all of the objectives set forth by providing a new and improved firearm bipod that is portable, yet easily erectable in the field; that includes two intergageable strut portions and relatively simple means for erecting the two strut portions thereof at the required angular relationship so that the bipod of the invention may readily provide a firm, vibration free base for a weapon in firing position; and that may be used with weapons of different type, e.g. pistols and/or rifles.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use. For example, the axially adjustable arm rest may be emplaced on the second strut rather than on the first strut, if desired.

Hence, the proper scope of the present invention should be determined only by the broadest interpretation of the appended claims so as encompass all such modifications as well as all relationships equivalent to those illustrated in the drawings and described in the specification.

What is claimed as being new and desired to be protected by Letters Patent of the United States is as follows:

1. A new and improved firearm bipod comprising:

an elongated first strut having a top end and a bottom end and a first longitudinal axis, an elongated second strut having a top end and a bottom end and a second longitudinal axis, means for connecting said first strut to said second strut such that said top end of said second strut engages said first strut proximal to the top end thereof and said first axis intersects said second axis, and arm means extending from either said first strut or said second strut for providing support for a firearm, wherein said means for connecting includes a hinge pin passing transversely through said first strut proximal to the top end thereof, and tab means attached to said second strut proximal to the top end thereof and being further attached to said hinge pin to enable pivotal movement between said first and second struts from a first condition where said first axis intersects said second axis to a second condition where said first axis is parallel to said second axis.

2. The firearm bipod of claim 1 further including spring clip means for retaining said second strut relative to said first strut in said second condition.

3. A new and improved firearm bipod comprising:

an elongated first strut having a top end and a bottom end and a first longitudinal axis, an elongated second strut having a top end and a bottom end and a second longitudinal axis, means for connecting said first strut to said second strut such that said top end of said second strut engages said first strut proximal to the top end thereof and said first axis intersects said second axis, and arm means extending from either said first strut or said second strut for providing support for a firearm wherein said means for connecting includes an oblong slot in said first strut for receiving said top end of said second strut and said top end of said second strut has a beveled surface.

4. The firearm bipod of claim 3 wherein said second strut includes a series of axially spaced resilient grommets thereon.

5. The firearm bipod of claim 3 said first strut having a hollow interior defining an elongated cavity, said second strut being sized and shaped to be received coaxially and telescopically within said cavity.

6. The firearm bipod of claim 5 further including removable handle means for said second strut, and means on said second strut for connecting said handle means to the beveled top end thereof whereupon said handle means defines a shoulder adapted to engage said top end of said first strut when said second strut is coaxially and telescopically received therein.

7. The firearm bipod of claim 3 wherein said arm means includes means for axially adjusting said arm means on either said first strut or said second strut.

8. The firearm bipod of claim 7 wherein said axially adjustment means comprises a collar and a set screw transversely mounted on said collar.

9. The firearm bipod of claim 7 wherein said arm means extends orthogonally from either said first strut or said second strut and includes a first portion proximal to either said struts, a middle portion of reduced thickness to define a cradle, and a third distal portion of enlarged shape to provide means for maintaining a firearm or other object on said cradle portion.

10. A new and improved firearm bipod comprising:

an elongated first strut having a top end and a bottom end and a first longitudinal axis, an elongated second strut having a top end and a bottom end and a second longitudinal axis, means for connecting said first strut to said second strut such that said top end of said second strut engages said first strut proximal to the top end thereof and said first axis intersects said second axis, and arm means extending from either said first strut or said second strut for providing support for a firearm, said arm means extending from said first or second strut at a location thereon below said intersection of said first and second axis.

* * * * *